United States Patent [19]

Bauer

[11] 4,173,529

[45] Nov. 6, 1979

[54] HYDROTREATING OF PYROLYSIS GASOLINE

[75] Inventor: William V. Bauer, New York, N.Y.

[73] Assignee: The Lummus Company, Bloomfield, N.J.

[21] Appl. No.: 910,822

[22] Filed: May 30, 1978

[51] Int. Cl.[2] ..... C10G 23/00

[52] U.S. Cl. ..... 208/255

[58] Field of Search ..... 208/255

[56] References Cited

U.S. PATENT DOCUMENTS

| | | | |
|---|---|---|---|
| 3,215,750 | 11/1965 | Benesi | 208/255 |
| 3,537,982 | 11/1970 | Parker | 208/255 |
| 3,853,748 | 12/1974 | Tabler | 208/255 |

*Primary Examiner*—George Crasanakis

*Attorney, Agent, or Firm*—Louis E. Marn; Elliot M. Olstein

[57] ABSTRACT

In the catalytic hydrotreating of pyrolysis gasoline, the major portion of dienes present in the hydrotreated product concentrate in the $C_5$ fraction. The $C_5$ fraction is separated from a first portion of the hydrotreated effluent and a portion of said separated $C_5$ fraction is combined with a second portion of the hydrotreated effluent as a combined recycle stream to the hydrotreating reaction. By combining a portion of the separated $C_5$ fraction with the recycle hydrotreated effluent, the net $C_5$ product recovered from the process has a diene value which is lower than that which would be obtained without the $C_5$ recycle.

14 Claims, 1 Drawing Figure

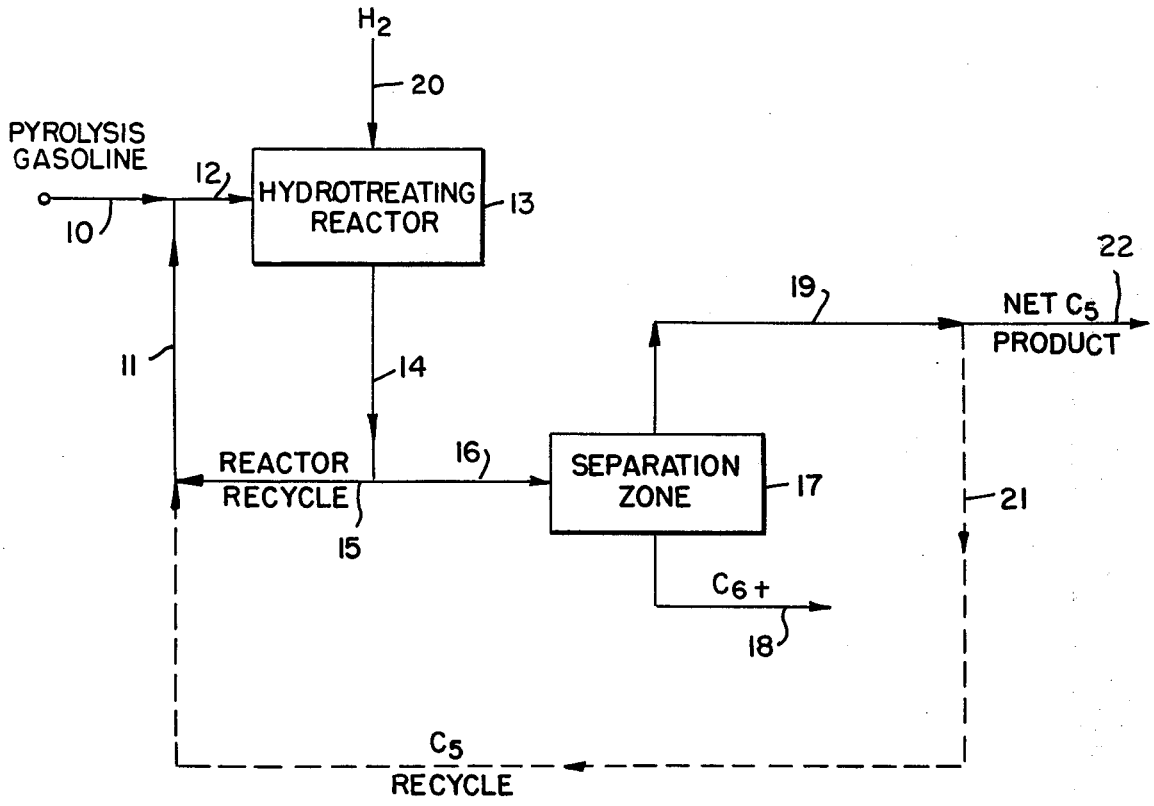
H2
20
PYROLYSIS GASOLINE
12
HYDROTREATING REACTOR
13
10
22
19
NET C5 PRODUCT
11
14
REACTOR RECYCLE
16
SEPARATION ZONE
17
21
15
C6+
18
C5 RECYCLE

HYDROTREATING OF PYROLYSIS GASOLINE

This invention relates to the hydrotreating of a pyrolysis gasoline.

Pyrolysis gasoline or Dripolene (such terms are generally interchangeably employed in the art) is catalytically hydrotreated in order to reduce the Diene Value thereof; e.g., U.S. Pat. No. 3,429,804.

The hydrotreated product is often separated into three fractions:

(1) A $C_5$ fraction;

(2) A $C_6$ to $C_8$ fraction; and (3) A $C_9$ to 400° F. fraction.

The $C_6$ to $C_8$ fraction is used for aromatics recovery, while the first and third fractions are combined with the raffinate from the aromatics recovery and employed in the gasoline pool.

Applicant has found that although such hydrotreating results in an overall reduction in the diene value, a major portion of the dienes present in the hydrotreated product concentrates in the $C_5$ fraction. As a result, the $C_5$ fraction has a Diene Value which is greater than the Diene Value of the total hydrotreated product.

In accordance with the present invention there is provided an improvement in the process for the catalytic hydrotreating of a pyrolysis gasoline to reduce the diene content thereof wherein a hydrotreated product portion is recycled to the hydrotreating by separating a $C_5$ fraction from the hydrotreated effluent and employing a portion of the separated $C_5$ fraction as a portion of the hydrotreated product portion recycled to the hydrotreating to thereby reduce the Diene Value of the net $C_5$ fraction.

In accordance with the present invention, a portion of the recycle requirements to the hydrotreating are provided by a portion of the $C_5$ fraction recovered from the total effluent to thereby provide a net $C_5$ fraction having a diene value which is lower than that which would be obtained without recycle of the $C_5$ fraction, and without increasing the Diene Value of the total hydrotreated effluent. Applicant has further found that by employing a portion of the separated $C_5$ fraction for providing total recycle requirements, there is obtained a significant drop in the Diene Value of the $C_5$ fraction, with only a small increase in the Diene Value of the non-$C_5$ fraction.

The amount of separated $C_5$ fraction employed as recycle is dependent upon the desired Diene Value for the net $C_5$ fraction, with an increase in the amount of $C_5$ fraction recycle reducing the Diene Value of the net $C_5$ fraction. In accordance with the present invention, the amount of $C_5$ fraction in the recycle is employed to control the Diene Value of the net $C_5$ fraction in a manner such that the Diene Value of the net $C_5$ fraction approaches or even equals the Diene Value of the total effluent.

In general, the hydrotreating of the pyrolysis gasoline is effected to provide an effluent having a Diene Value of less than 4, generally in the order of 1.0 to 2.5 and the $C_5$ fraction is recycled in an amount to provide a net $C_5$ fraction having a Diene Value of less than 5 and generally in the order of from 1.5 to 3.0.

In effecting the hydrotreating, the recycle to the hydrotreating is generally in an amount to provide a recycle to fresh feed ratio of from about 1:1 to 10:1, and preferably from about 2:1 to 8:1, all by weight. The separated $C_5$ fraction, as hereinabove noted, forms part of such recycle, and such separated $C_5$ fraction is generally recycled in an amount to provide a ratio of the concentration of $C_5$'s in the recycle to the concentration of the $C_5$'s in the fresh feed of at least 1.2:1, and generally in the order of from 1.5 to 5:1.

The hydrotreating of a pyrolysis gasoline is effected at conditions generally known in the art. In general, such hydrotreating is effected at a temperature in the order of from about 120° F. to about 450° F., preferably from about 140° F. to about 400° F., and at pressures in the order of from about 150 to about 1000 psig, preferably in the order of from about 250 to about 500 psig.

The hydrogen containing gas employed in the hydrotreating is generally employed in an amount which is in excess of the stoichiometric requirements, with such excesses generally being in the order of from about 10 to 50% over that required to saturate one double bond of dienes and styrenes in the feed. In general, the temperature rise through the reactor is in the order of from about 50° F. to about 100° F.

The conditions for effecting hydrotreating, as hereinabove noted, are generally known in the art, and the selection of such conditions is deemed to be well within the scope of those skilled in the art.

The hydrotreating is effected in the presence of a suitable hydrotreating catalyst. The hydrotreating catalyst can be a noble metal catalyst; e.g., palladium, with or without modifiers supported on alumina, or a non-noble metal catalyst, such as nickel alone, or in combination with tungsten or molybdenum or a cobalt-molybdenum catalyst. The catalysts which are suitable for the hydrotreating of pyrolysis gasolines are known in the art, and the selection of a suitable catalyst is deemed to be well within the scope of those skilled in the art from the teachings herein.

The pyrolysis gasoline or Dripolene feeds treated in accordance with the present invention are well known in the art. As known in the art, such feeds are unstable liquids boiling in the gasoline range which are produced, as byproducts, in hydrocarbon cracking or pyrolysis processes. Pyrolysis gasoline generally boils in the range of from 50° to 400° F. and includes olefins (di-olefins and mono-olefins), aromatic constituents, together with mercaptan sulfur. Such pyrolysis gasolines generally have a Diene Value of from 20 to 100, and most usually from 25 to 75.

The invention will be further described with respect to an embodiment thereof illustrated in the accompanying drawing:

The drawing is a simplified schematic flow diagram of an embodiment of the present invention.

The drawing does not depict valves, pumps, exchangers and the like, and the use of appropriate places is deemed to be within the scope of those skilled in the art.

Referring now to the drawing, pyrolysis gasoline in line 10 is admixed with recycle hydrotreated product in line 11, obtained as hereinafter described, and the combined stream in line 12 is introduced into a hydrotreating reactor, containing a bed of a suitable hydrotreating catalyst, schematically generally indicated as 13. A hydrogen containing gas, for example a gas recovered from an olefin plant, in line 20 is also introduced into reactor 13. In reactor 13, as known in the art, the pyrolysis gasoline is hydrogenated to selectively hydrotreat the dienes and styrenes present in the pyrolysis gasoline.

The liquid hydrotreated effluent is withdrawn from reactor 13 through line 14 and a first portion thereof is employed for recycle in line 15.

The remaining portion in line 16 is introduced into a separation zone, schematically indicated as 17, to effect separation of a $C_5$ fraction from a $C_6+$ fraction which is recovered through line 18.

The $C_5$ fraction is withdrawn from separation zone 17 through line 19 and a portion thereof employed for recycle in line 21, with the net $C_5$ product being recovered through line 22.

The $C_5$ recycled portion in line 21, and the total reactor effluent recycle portion in line 15 are combined in line 11 for recycle to the hydrotreating reactor 13.

In accordance with the present invention, as hereinabove noted, the amount of $C_5$ recycle in line 21 for providing the total recycle requirements in line 11 is controlled so that the Diene Value of the net $C_5$ product recovered in line 22 approaches or even equals the Diene Value of the total effluent recovered in line 14. In accordance with the present invention, such a decrease in the Diene Value of the net $C_5$ product is obtained without significantly increasing the Diene Value of the non-$C_5$ fraction recovered in line 18.

Thus, in accordance with the present invention, the total recycle is maintained at the desired value, with the portion of the recycle in lines 21 and 15 being adjusted to provide the desired decrease in the Diene Value of the net $C_5$ product, and without increasing the Diene Value of the total effluent recovered in line 14, and with only a small increase in the Diene Value of the non-$C_5$ fraction recovered in line 18.

The present invention will be further described with respect to the following example; however, the scope of the invention is not to be limited thereby:

EXAMPLE

In the base case, the Diene Value of the pyrolysis gasoline in line 10 is 60, with the $C_5$'s weight fraction thereof being 0.2. The Diene Value of the $C_5$ fraction in the feed is 186, and the Diene Value of remaining (non-$C_5$) fraction is 28.6.

The hydrotreating is effected at a ratio of recycle to fresh feed of 5:1.

In the case where all of such recycle is provided from the hydrotreated effluent; i.e., all of the recycle in line 11 is obtained from line 15, the Diene Value of the effluent in line 14 is 2.0, with the Diene Value of the $C_5$ being 4.0 and the Diene Value of the remaining (non-$C_5$) fraction being 1.5.

In modifying the recycle in accordance with the present invention, wherein the ratio of recycle to fresh feed is maintained at 5:1, with the recycle in line 21 of the $C_5$ fraction being in an amount to provide a treated $C_5$ fraction equal in weight to the $C_5$'s present in the pyrolysis gasoline feed, with the remainder of the recycle being provided through line 15, the Diene Value of the total product in line 14 is 1.99, the Diene Value of the $C_5$ net product in line 22 is 2.42 and the Diene Value of the remaining (non-$C_5$) fraction in line 18 being 1.78.

Numerous modifications and variations of the present invention are possible in light of the above teachings and, therefore, within the scope of the appended claims, the invention may be practised otherwise than as particularly described.

I claim:

1. In a process for the catalytic hydrotreating of a pyrolysis gasoline to reduce the diene content thereof wherein a hydrotreated product portion is recycled to the hydrotreating, the improvement comprising:

separating a $C_5$ fraction from the hydrotreated effluent; and employing a portion of the separated $C_5$ fraction as a portion of the hydrotreated product portion recycled to the hydrotreating to thereby reduce the Diene Value of a remaining net $C_5$ product.

2. The process of claim 1 wherein the hydrotreated effluent has a Diene Value of less than 4 and the separated $C_5$ fraction is recycled in an amount to provide a remaining net $C_5$ product having a Diene Value of less than 5.

3. The process of claim 2 wherein the Diene Value of the hydrotreated effluent is from 1.0 to 2.5 and the Diene Value of the remaining net $C_5$ product is from 1.5 to 3.0.

4. The process of claim 3 wherein the hydrotreating is effected at a temperature of from 120° F. to 450° F. and at a pressure of from 150 to 1000 psig.

5. The process of claim 3 wherein the separated $C_5$ fraction is recycled in an amount to provide a ratio of the concentration of $C_5$'s in the recycled hydrotreated product portion to $C_5$'s in pyrolysis gasoline fresh feed of at least 1.2:1.

6. The process of claim 5 wherein the ratio is from 1.5:1 to 5:1.

7. The process of claim 4 wherein the hydrotreating is effected in the presence of a noble metal catalyst.

8. In a process for the catalytic hydrotreating of a pyrolysis gasoline feed to reduce the diene content thereof, the improvement comprising:

recovering a hydrotreated effluent from said hydrotreating; separating from a first portion of the hydrotreated effluent a $C_5$ fraction; employing a portion of the separated $C_5$ fraction and a second portion of the hydrotreated effluent as a combined recycle to said hydrotreating, said combined recycle being employed to provide a combined recycle to pyrolysis gasoline feed ratio of from 1:1 to 10:1, and said portion of the separated $C_5$ fraction employed in the combined recycle is present in an amount to provide a ratio of the concentration of $C_5$'s in the combined recycle to $C_5$'s in the pyrolysis gasoline feed of at least 1.2:1.

9. The process of claim 8 wherein said portion of the separated $C_5$ fraction in said combined recycle is employed in an amount to provide a remaining net $C_5$ product having a diene value of less than 5.

10. The process of claim 9 wherein the diene value of the hydrotreated effluent is from 1.0 to 2.5 and the diene value of the remaining net $C_5$ product is from 1.5 to 3.0.

11. The process of claim 10 wherein the hydrotreating is effected at a temperature of from 120° F. to 450° F. and at a pressure of from 150 to 1000 psig.

12. The process of claim 11 wherein the ratio of the concentration of $C_5$'s in the combined recycle to $C_5$'s in the feed is from 1.5:1 to 5:1.

13. The process of claim 9 wherein the pyrolysis gasoline feed has a diene value of from 20 to 100.

14. The process of claim 1 wherein the pyrolysis gasoline which is hydrotreated has a diene value of from 20 to 100.

* * * * *